US007111742B1

(12) United States Patent
Zimmermann

(10) Patent No.: US 7,111,742 B1
(45) Date of Patent: Sep. 26, 2006

(54) DEVICE FOR SEPARATING POSTAL ITEMS ACCORDING TO THICKNESS CLASSES

(75) Inventor: Armin Zimmermann, Constance (DE)

(73) Assignee: Siemens Aktiengesellschaft, Munich (DE)

( * ) Notice: Subject to any disclaimer, the term of this patent is extended or adjusted under 35 U.S.C. 154(b) by 172 days.

(21) Appl. No.: 10/487,507

(22) PCT Filed: Aug. 2, 2002

(86) PCT No.: PCT/DE02/02850

§ 371 (c)(1),
(2), (4) Date: Feb. 20, 2004

(87) PCT Pub. No.: WO03/018215

PCT Pub. Date: Mar. 6, 2003

(30) Foreign Application Priority Data

Aug. 23, 2001 (DE) ..... 101 41 375

(51) Int. Cl.
*B07C 5/12* (2006.01)

(52) U.S. Cl. ..... 209/665; 209/900

(58) Field of Classification Search ..... 209/900, 209/621, 622, 625, 660, 665
See application file for complete search history.

(56) References Cited

U.S. PATENT DOCUMENTS

| | | | | |
|---|---|---|---|---|
| 709,658 | A * | 9/1902 | Aspinwall | 209/665 |
| 2,895,610 | A | 7/1959 | Copping et al. | 209/98 |
| 2,937,739 | A * | 5/1960 | Levy | 198/352 |
| 3,273,711 | A * | 9/1966 | Smith | 209/625 |
| 4,030,607 | A | 6/1977 | Suda et al. | 209/74 |
| 4,149,637 | A * | 4/1979 | Starr | 209/621 |
| 4,687,106 | A | 8/1987 | Prins | 209/552 |
| 4,723,660 | A * | 2/1988 | Sjoberg | 209/622 |
| 4,886,596 | A | 12/1989 | Sasage et al. | 209/539 |
| 5,143,226 | A * | 9/1992 | Walton | 209/624 |
| 5,171,403 | A | 12/1992 | Chase et al. | 162/197 |
| 5,297,062 | A | 3/1994 | Cresson et al. | 364/564 |
| 5,637,811 | A | 6/1997 | Simard et al. | 73/865.8 |
| 5,704,246 | A | 1/1998 | Kruger | 73/159 |
| 5,934,140 | A | 8/1999 | Jackson et al. | 73/159 |

(Continued)

FOREIGN PATENT DOCUMENTS

| | | |
|---|---|---|
| AU | 532033 | 5/1983 |

(Continued)

*Primary Examiner*—Donald P. Walsh
*Assistant Examiner*—Matthew J. Kohner
(74) *Attorney, Agent, or Firm*—Philip G. Meyers

(57) ABSTRACT

The invention relates to a device for separating flat postal items according to thickness classes. A rigid system of overlapping lamellae (5) on two continuous traction mechanisms (3) revolving on two deflection rollers (4) provides a lamella-type conveyor belt. The lamellae (5), in the end zones of the belt, are inclined outward at the same angle, thereby forming inward-leading gaps in between them. The lamella-type conveyor belt is inclined with respect to the horizontal to such an extent that postal items (10) that are conveyed to the lower part of the belt transporting the postal items upwards can slide, due to their gravity, into the interior of the lamella-type conveyor belt through the downward leading gaps if they are thinner than the gap width. The sorted out postal items (11) slide onto a transport device (7) by means of rigid guides (6) in the interior of the lamella-type conveyor belt. Said transport device transports the postal items laterally outward from the lamella-type conveyor belt. At least one additional similar lamella-type conveyor belt is disposed at a slight distance behind the first conveyor belt, inclined at the same angle with respect to the horizontal.

4 Claims, 1 Drawing Sheet

U.S. PATENT DOCUMENTS

Figure 1:
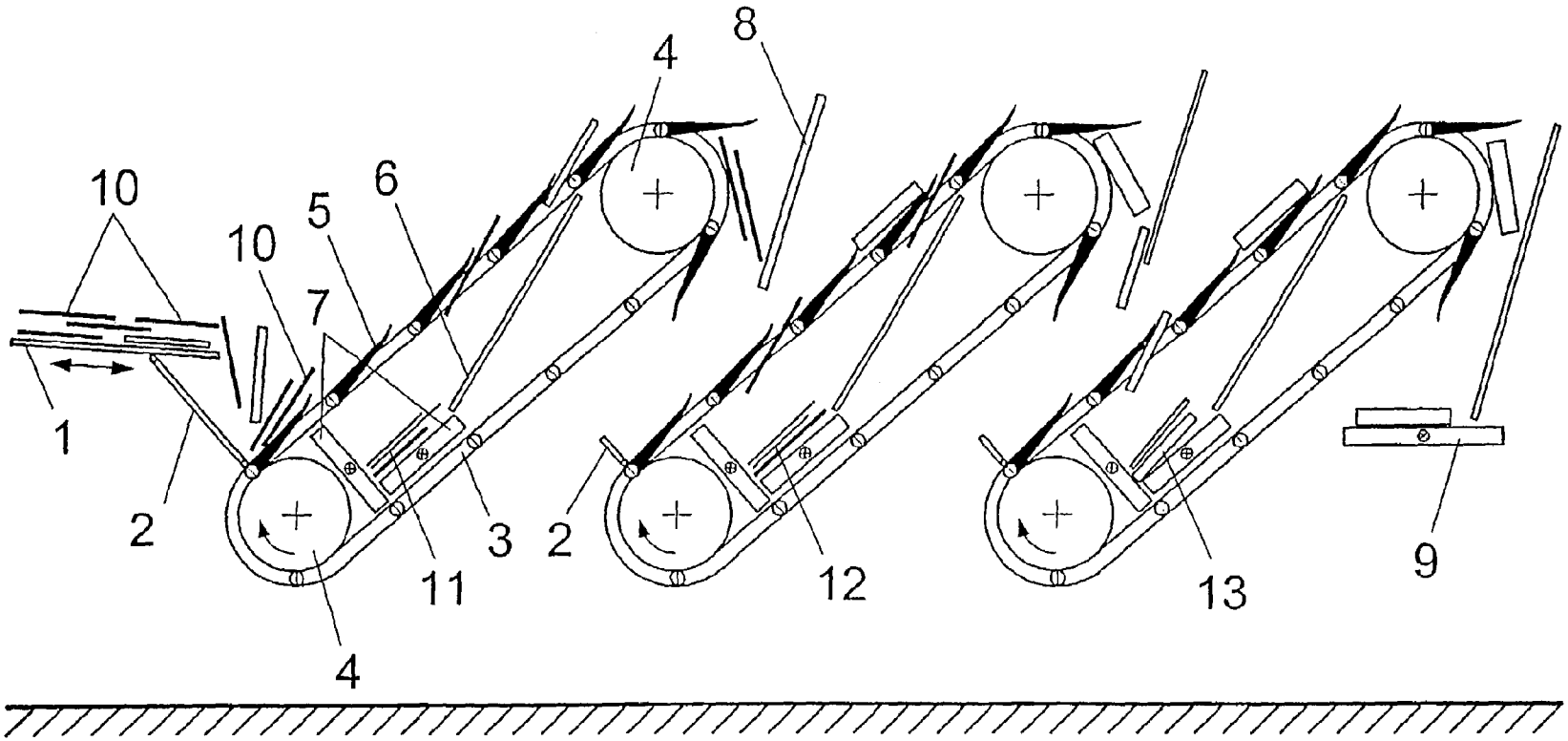

| | | | | |
|---|---|---|---|---|
| 6,026,681 | A | 2/2000 | Wunderer et al. | 73/159 |
| 6,032,517 | A | 3/2000 | Reisig et al. | 73/78 |
| 6,401,937 | B1 * | 6/2002 | Schmidt | 209/674 |
| 6,521,854 | B1 * | 2/2003 | Tanimoto | 209/586 |

FOREIGN PATENT DOCUMENTS

| | | | |
|---|---|---|---|
| DE | 100 38 690 | C1 | 7/2001 |
| GB | 2100 691 | A | 1/1983 |
| JP | 06114339 | | 4/1994 |
| WO | WO 2003018215 | A1 * | 3/2003 |

* cited by examiner

DEVICE FOR SEPARATING POSTAL ITEMS ACCORDING TO THICKNESS CLASSES

The invention relates to an apparatus for separating items of mail into thickness categories according to the preamble of claim 1.

In order for it to be possible for the items of mail to be processed mechanically during sorting and distribution, they have to be separated into different size categories as they enter, since the transporting and sorting equipment is geared to different categories. There are thus different installations for packages and parcels, and large letters and normal letters. In addition to the format, these differ, in particular, in thickness.

Drum-like separators have been known for some time now for the purpose of subdividing the incoming items of mail automatically into different thickness categories. These separators have, on their cylindrical frame, overlapping lamellae which can be pivoted between two positions. The drum, which is open on the end sides, has its longitudinal axis inclined slightly (approximately 4°) in relation to the horizontal.

The lamellae are inclined inward in relation to the tangential direction in the direction of rotation of the drum and can be pivoted between two inclined positions limited by stops. A resilient element fastened on the frame acts on each lamella such that, in the bottom drum region, the lamella is drawn onto the stop limiting the small amount of inclination, i.e. there are only narrow gaps, e.g. 6 mm, between the lamellae, through which as the drum revolves, during upward movement, in the bottom part the correspondingly thin items of mail slide and are intercepted, and transported away, beneath the drum. The thicker items of mail, which do not fit through these gaps, remain in the drum and are transported in a helical movement, as a result of the oblique positioning of the drum, to the bottom end thereof, where they are collected or transported away. During this transportation by the drum, it may be the case that items of mail jam in the gaps between the lamellae. In order that they can be released again from this jamming, the lamellae are mounted in a pivotable manner. During the rotary movement, the lamellae pass into the top part of the drum. In this case, the spacing between the mass center of gravity of the lamellae and their point of rotation continues to increase. If the resulting torque exceeds the torque which is produced by the resilient element, then the lamellae are inclined to a more pronounced extent (as far as the second stop) and the gaps between the lamellae are increased. The items of mail jammed in the gaps are thus freed and they drop onto the base of the drum. It is also the case that thick items of mail which do not fit into the gaps, but are carried along relatively far upward by the centrifugal force before likewise dropping downward, drop down (GB 21 00 691 A). Hard and compact items of mail (e.g. parcels) or items of mail with heavy contents and comparatively large and unstable wrapping are subject to multiple impact in the bottom region of the drum and may destroy or damage themselves and other items of mail.

In order to prevent this, DE 100 38 690 C1 has provided a solution in which two clamped membranes are fixed in space one above the other in the rotating drum, with the result that the large drop in height is reduced.

These drums for separating into two categories, however, are very large and involve high outlay (lamellae mounted in a movable manner). If the items of mail are to be separated into more than two categories, then it is necessary to use a number of these large drums.

The object of the invention is thus to provide a low-outlay apparatus for separating flat items of mail into thickness categories which, while requiring only a small amount of space, also allows separation into more than two thickness categories.

The object is achieved according to the invention by the features of claim 1.

A lamellar conveying belt is formed by the lamellae being arranged rigidly on two endless pulling means circulating on two deflecting rollers, the lamellae being inclined outward at equal angles in the strand regions, with the result that inwardly leading gaps are produced between them.

The lamellar conveying belt is inclined in relation to the horizontal such that items of mail which are conveyed onto the bottom part of the strand which transports the items of mail upward can slide, on account of their gravitational force, through the downwardly leading gaps into the interior of the lamellar conveying belt, if they are thinner than the gap width. With the aid of fixed guides in the interior of the lamellar conveying belt, the separated-out items of mail slide onto a transporting means, which transports the items of mail laterally out of the lamellar conveying belt.

At least one further lamellar conveying belt of the same type is arranged at a small distance downstream, at the same angle of inclination in relation to the horizontal, such that the items of mail which do not slide between the lamellae into the interior of the respective lamellar conveying belt are directed downward from the top deflecting portion, with the aid of guide means, onto the bottom section of that strand of the respectively following lamellar conveying belt which transports the items of mail upward. In this case, the thicknesses of the items of mail which are transported laterally laterally out of the lamellar conveying belts are smaller than the gap widths in the strand section.

If items of mail have jammed between the lamellae, then they are freed again at the deflecting portions since, there, on account of the curved path of the pulling means, the lamellae, which are fastened rigidly thereon, are spread apart from one another. This apparatus allows a compact and low-outlay construction.

Advantageous configurations of the invention are explained in the subclaims.

It is thus advantageous, for dividing up the stream of mail into more than two thickness categories, to increase the gap widths between the lamellae in the subsequent lamellar conveying belts.

In order to assist the sorting operation on the lamellar conveying belts, it is advantageous for the latter to be mounted on vibration-generating oscillating means.

It is also advantageous for the free ends of the lamellae to be angled away from the pulling means, with the result that the gap increases in the outward direction and the items of mail pass more easily between the lamellae.

The invention is explained in more detail hereinbelow by way of an exemplary embodiment and with reference to the drawing, in which:

FIG. 1 shows a schematic side view of a separating apparatus with three separating stages.

First of all, the flat items of mail 10 pass via a feed arrangement 1, which may be designed both actively as a driven underfloor belt and passively as a chute, onto the bottom part of a strand which transports the items of mail 10 upward and belongs to a driven lamellar conveying belt which is inclined upward in relation to the horizontal. In order that the items of mail 10 cannot slide downward from the lamellar conveying belt, an intercepting plate 2 is located at the bottom end of the strand, and oriented perpendicularly to the strand surface. The lamellar conveying belt comprises two circulating, endless pulling means 3 which are driven and guided by deflecting rollers 4 and on which the lamellae are rigidly fastened by way of their lateral ends, in an outwardly inclined manner, at equal intervals with their longitudinal axes perpendicular to the movement direction. The lamellar conveying belt is inclined upward in relation to the horizontal. The inclination of the lamellae 5 in relation to the pulling means 3 is selected in accordance with the desired gap width, and the inclination of the lamellar conveying belt in relation to the horizontal is selected, such that the correspondingly narrow items of mail 10, as they are transported upward on the lamellae 5, can easily slide, on account of their gravitational force, through the gaps formed between the lamellae 5 and into the interior of the lamellar conveying belt.

The interior of the latter contains, perpendicularly to one another, two conveying belts 7 as transporting means, which conveys the separated-out items of mail 11 perpendicularly to the viewing plane, and a directing plate 6 as guide means, by which the items of mail 11 which slide through the gaps are directed to the conveying belts 7. The lamellae 5 are angled outward at their tips in order to facilitate the introduction of the items of mail 11 into the gap.

As they are transported upward, large piles of mail slide back, in part, to the intercepting plate 2, in order then to be carried along again by the lamellae 5.

Excessively thick items of mail 10 and small piles of mail which have jammed in the gaps are transported to the top deflecting portion. There, the lamellae 5 are spread apart from one another on account of the deflecting radius, the jamming is released and all the items of mail 10 slide from the top end of the transporting strand, via a further directing plate 8 as guide means, onto the bottom part of a second lamellar conveying belt of the same type, which is located closely downstream of the first.

Here, the separating-out operation takes place in the same manner described and the items of mail which are not separated out pass, via the further directing plate 8 of this lamellar conveying belt, into the third and last lamellar conveying belt of the same type. The items of mail 11, 12, 13 which are separated out in all three stages, and transported away via the conveying belt 7, pass into a collecting container or are fed for further processing from three separate containers. The items of mail 10 which are not separated out are fed to a conveying belt 9, via the further directing plate 8 of the last stage, or they are sorted into further thickness categories via further sorting stages (not illustrated) for larger thicknesses.

What is claimed is:

1. An apparatus for separating flat items of mail into thickness categories by means of moving, gap-forming, overlapping lamellae arranged one behind the other, characterized in that the lamellae are rigidly fastened laterally, in an outwardly inclined manner, at equal intervals on two endless, circulating pulling means, which are driven and guided via deflecting rollers, with their longitudinal axes perpendicular to the movement direction, to form a lamellar conveying belt, the lamellae spreading apart from one another during deflection on the deflecting rollers, in that the lamellar conveying belt is inclined upward in relation to the horizontal such that, when the items of mail conveyed onto the bottom part of the lamellar conveying belt are transported upward, individual items of mail which are narrower than the gaps between the lamellae, which are inclined outward at equal angles in the strand regions, slide, by virtue of their gravitational force, through the gaps between the two strands onto a transporting means which transports the items of mail laterally out of the lamellar conveying belt, in that at least one further lamellar conveying belt of the same type is arranged at a small distance downstream, at the same angle of inclination in relation to the horizontal, such that the items of mail which do not slide between the lamellae into the interior of the respective lamellar conveying belt are directed downward from the top deflecting portion, with the aid of guide means, onto the bottom section of that strand of the respectively following lamellar conveying belt which transports the items of mail upward, the thicknesses of the items of mail which are transported laterally out of the lamellar conveying belts not exceeding a maximum thickness which is defined by the gap widths.

2. The apparatus as claimed in claim 1, characterized in that, for dividing up the stream of mail into a number of thickness categories, subsequent lamellar conveying belts have increasing gap widths.

3. The apparatus as claimed in claim 1, characterized in that the lamellar conveying belts are mounted on oscillating means for the purpose of generating vibrations.

4. The apparatus as claimed in claim 1, characterized in that the free ends of the lamellae are angled away from the pulling means.

* * * * *